United States Patent [19]

Van Alstine et al.

[11] 3,972,403

[45] Aug. 3, 1976

[54] DECODING MEANS FOR USE WITH A TYPEWRITER

[76] Inventors: Cyle Van Alstine, 834 Briar Hill Drive, Island Lake, Ill. 60042; William E. Webb, 1126 Algonquin Road, Schaumburg, Ill. 60172

[22] Filed: Sept. 5, 1974

[21] Appl. No.: 503,271

[52] U.S. Cl. ..... 197/19; 335/206; 335/207

[51] Int. Cl.[2] ..... B41J 5/30

[58] Field of Search ..... 197/19.98, 180; 178/17 C; 335/205–207

[56] References Cited

UNITED STATES PATENTS

| | | | |
|---|---|---|---|
| 3,505,869 | 4/1970 | Crawford | 335/206 X |
| 3,533,029 | 10/1970 | Steinbach et al. | 335/206 |
| 3,573,808 | 4/1971 | Pear, Jr. | 178/17 C X |
| 3,573,810 | 4/1971 | Hanewinkle | 178/17 C X |
| 3,612,240 | 10/1971 | Parker | 178/17 C X |
| 3,648,817 | 3/1972 | Siegel | 197/19 |
| 3,651,259 | 3/1972 | Hoffman et al. | 178/17 C |
| 3,656,181 | 4/1972 | Pack | 335/205 |

OTHER PUBLICATIONS

*Handbook of Tradenames*, Zimmerman and Lavine, 1953 edition p. 34, Allegheny Mumetal.

*Primary Examiner*—Paul E. Shapiro
*Attorney, Agent, or Firm*—Fitch, Even, Tabin & Luedeka

[57] ABSTRACT

Apparatus for attachment to a standard typewriter for selectively actuating one or more of a plurality of magnetically actuated switches in electrical circuits that are connected to recording means through an electrical matrix circuit. A switch and actuating lever are provided for each of the unique keys of the typewriter so that signals identifying the corresponding character or function can be produced. The apparatus is compact and can be easily installed beneath the keyboard under the typewrter. Pivotable actuating levers having magnets thereon move into close proximity to the magnetically actuated switches in response to striking of the typewriter keys. The apparatus also includes magnetic shielding for preventing a lever from actuating more than one switch, even though the switches can be in extremely close proximity to one another.

14 Claims, 4 Drawing Figures

FIG. 2
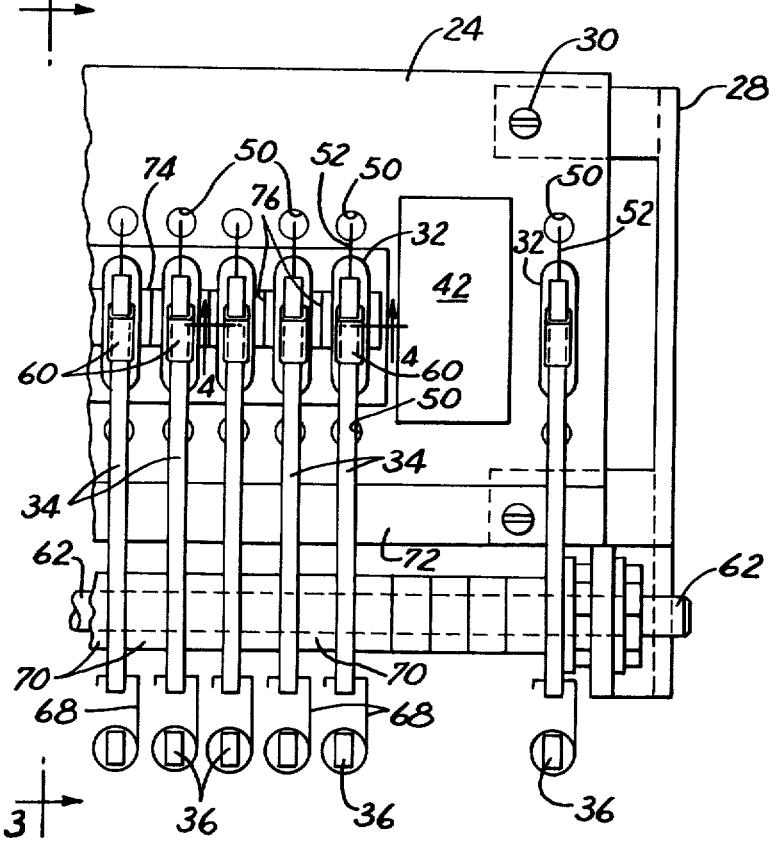
FIG. 3
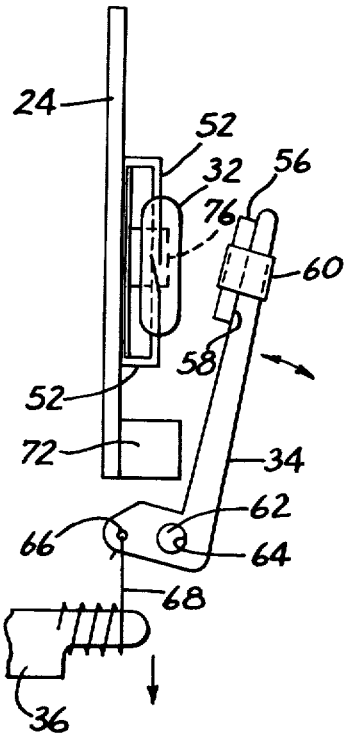
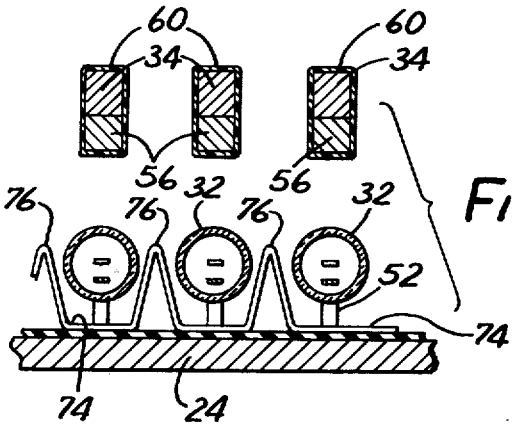
FIG. 4

DECODING MEANS FOR USE WITH A TYPEWRITER

The present invention relates generally to apparatus for translating mechanical information into electrical information and, more specifically, to apparatus adapted for attachment to a conventional typewriter for producing electrical signal information corresponding to the characters that are being typed.

Although there has been an extensive proliferation of different types of transmission systems for sending and receiving information between different geographical locations to meet the burgeoning needs of business and government, many of the conventional systems in use, such as TWX, telegrams, facsimile and computer printer terminals have one or more of the disadvantages of the high cost of equipment purchase or rental, or unusually long periods required during information transmission over the telephone system, such as is the case for most teleprinters and facsimile reproductions, or the terminal is not a typewriter that can be used as such when not preparing copy for transmission. Additionally, some systems require unusually inconvenient and expensive processing to place the information in proper form for transmission or reception or both.

While the advantages of rapid transmission and correspondingly lower telephone costs may be balanced against the typically larger cost of purchasing or renting the more sophisticated equipment that transmits and receives at high speed, it is quite evident that it would be desirable to have an apparatus that would require virtually no extraordinary processing of information prior to transmission and would rapidly transmit the information over the telephone lines, particularly if such advantages could be coupled with typewriter equipment that is relatively inexpensive to purchase or rent.

This is particularly true for an organization that has a relatively large network of offices located in many geographic areas and which requires transmission of priority information. For example, in the event a home office or processing center must receive information for immediate processing such as sales orders, invoices, purchase orders, inventory reports, production schedules, critical news or business reports and the like, from field or branch offices, it is desirable to have a system for rapidly transmitting such information at a low overall cost.

Accordingly, it is a primary object of the present invention to provide an improved apparatus for use in a transmission system which sends information signals over the telephone system at high speed, and which is adapted for attachment to a conventional typewriter and reliably decodes the typed character information into such correct electrical matrix signals.

Other objects and advantages of the present invention will become apparent upon reading the following detailed description, in conjunction with the attached drawings, in which:

FIG. 2 is a plan view of a portion of the apparatus shown in FIG. 1;

FIG. 3 is an end view taken generally in the direction of the arrows 3—3 shown in FIG. 2; and, FIG. 4 is a cross section taken generally along the line 4—4 of FIG. 2.

Figure 1:
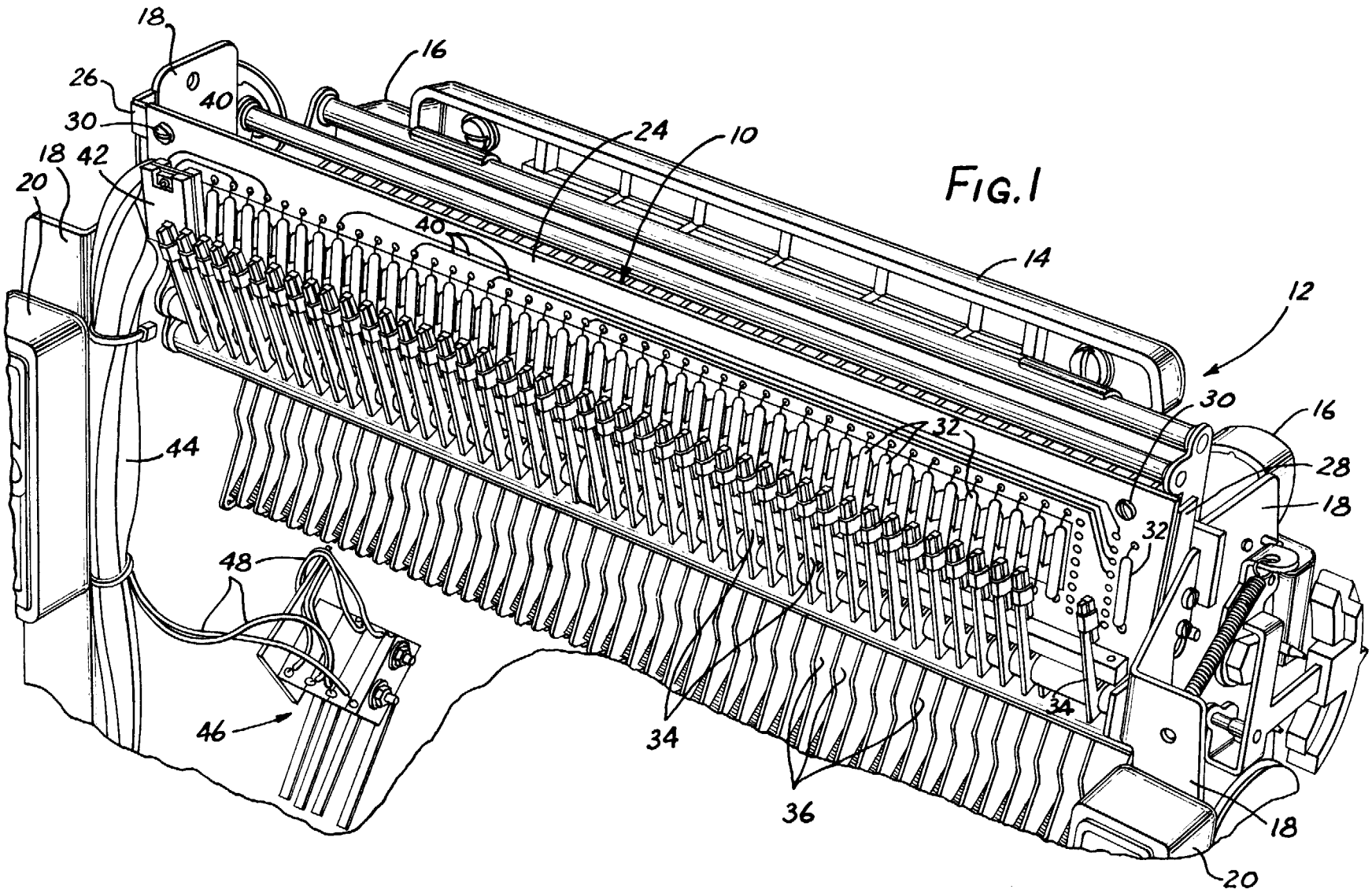
FIG. 1 is a perspective view of the bottom of a portion of a conventional typewriter, shown together with apparatus embodying the present invention.

Broadly stated, the present invention is directed to apparatus which can be operatively connected to a conventional typewriter and which adapts the typewriter for use in providing electrical signals that can be recorded on a magnetic recording device or the like for subsequent local processing or transmission over telephone lines, as desired. The apparatus utilizes a plurality of small switches each of which can generate a signal that is at least partially indicative of a particular key or functional condition when that switch is actuated. By connecting the switches in electrical circuits that are conventionally matrixed, striking or depressing an individual key will generate unique signals that will inherently identify the key or character struck and this signal is recorded or otherwise stored. The recorded information can be transmitted and subsequently converted to useable form when received. The apparatus embodying the present invention may be easily installed in the underside of the typewriter beneath the keyboard. Because of the compactness of the apparatus, it does not detract from the normal appearance of the typewriter. The only change in the outward appearance of the typewriter is the presence of a relatively small connector and electrical conductor cable that interconnects the typewriter to a separate conventional cassette recorder or other storage device. Because the apparatus has a relatively compact design, it is easily attached to the typewriter with a minimum of difficulty and can be installed in a relatively short time, i.e., a very few hours. It should be understood that variations in the design of different typewriters may necessitate subtle structural differences in the apparatus of the present invention, as will be hereinafter described. However, it has been found that the apparatus of the present invention may be relatively easily installed on a variety of different typewriters.

More specifically, the apparatus embodying the present invention is intended to function in a data transmission system that incorporates a cassette recording device or other storage device on which a message can be recorded or stored concurrently as it is being typed on the typewriter. The apparatus is attached to the typewriter and has a plurality of electrical circuits that are individually responsive to actuation of respective typewriter keys and bars. Proper matrixing of the circuits produces unique signals which positively identify each of the characters or functions and the signals are recorded on a magnetic tape cassette or other storage device. Thus a signal identifying each character can be recorded when the corresponding typewriter key is depressed and the recorded information can subsequently be "batch" sent at high speed through the telephone system to another geographic location or used locally for processing. In this regard, it is contemplated that the information will be transmitted economically over dial telephone lines at rates up to about 180 characters per second and can be sent at rates of up to 960 characters per second if data volume so demands. With such high speed transmission, it should be easily understood that the time required for transmitting the data will be significantly shortened and correspondingly reduce the cost of long distance telephone service.

Turning now to the drawings and particularly FIG. 1, apparatus embodying the present invention, indicated generally at 10, is shown in its operating environment, having been operatively attached to the underside of a conventional typewriter 12 bemeath the keyboard thereof. While the particular perspective view shown in FIG. 1 fails to show the complete keyboard of the typewriter, the underside of a spacer bar 14 is clearly visible, as are shift keys 16. The typewriter structural frame members 18 and portions of feet 20 are also shown.

The apparatus 10 includes a relatively long flat mounting board 24 that extends generally the full width of the typewriter keyboard and is fastened to mounting brackets 26 and 28 located on opposite ends of the keyboard by screws 30 or the like. The mounting brackets 26 and 28 are similarly attached to the frame member 18 of the typewriter and firmly hold the mounting board 24 in the illustrated position. The apparatus 10 includes a plurality of switches 32 arranged adjacent one another along the length of the mounting board 24 and extending generally the full width of the typewriter keyboard. Each of the switches 32 is operably connected in an electrical circuit and the switches are actuated by respective pivotable actuating levers 34 so that a portion of the actuating levers are brought into close proximity to the individual switches 32. The actuating levers are mechanically compacted to linkage members 36 associated with each of the keys of the typewriter key mechanism so that striking of a typewriter key will cause its corresponding linkage member 36 to pivot the interconnected actuating lever 34 into close proximity to its associated switch 32 and thereby actuate the same to produce an electrical signal in the circuit. Since each of the keys of the typewriter (including space bars, shift levers and the like) preferably have a separate circuit associated therewith, proper electrical matrixing of the circuits can provide exact identification of the characters and function being typed and enables reliable recording and subsequent reproduction.

In accordance with an important aspect of the present invention, the mounting board 24, in addition to providing a mounting surface for each of the switches 32, also preferably comprises a printed circuit board, i.e., it is fabricated from an electrically insulating material upon which electrical conductors may be printed with conventional printed circuit board fabricating techniques. In this regard, lines 40 shown on the board 24 in FIG. 1 are representative of conductive paths that extend from each of the switches to the opposite end portions of the board 24 where connectors, such as conventional dual-inline-package connectors or the like are utilized to interconnect the printed conductors with flexible insulated conductors which are grouped in a bundle 44 shown in the left portion of FIG. 1 which extend to the cassette recording device (not shown) or other storage devices. In addition to the parallel aligned switches 32 mounted on the board, the apparatus preferably utilizes other switches 46 to decode additional functional operations, such as carriage return, back space, tabulator bar operation or the like, and these switches 46 are also connected by conductors 48 to the aforementioned recording device.

Turning now to the enlarged views of the apparatus embodying the present invention shown in FIGS. 2–4, the board 24 has a number of apertures 50 that are adapted to receive the conductive leads of the switches 32 which are preferably soldered therein. Also, the printed circuit leads or conductive paths preferably extend to the apertures so that soldering of the leads provides electrical continuity between the leads 52 of the switches in addition to securing the switches to the board. The switches 32 are relatively small, mangetically actuated reed switches that preferably have normally open contacts, and which will be actuated when a magnet is brought within close proximity thereto. In this regard, the switches are preferably glass encapsulated, but may be encapsulated in other suitable material that will not detrimentally affect the magnetic actuation and will provide physical protection. The switches have a single pair of contacts that will close in the presence of a magnetic strength within the range of about 15 to about 45 gauss.

To actuate the magnetic reed switches 32, each of the actuating levers 34 is provided with a permanent magnet 56 having opposite magnetic poles at opposite end portions thereof and having a magnetic force generally within the aforementioned range necessary to operate the switches when the magnet is moved into close proximity to one of the reed switches 32. As best shown in FIG. 3, the magnet is secured to the end of the actuating lever 34 by adhesive bonding at the interface 58 of the magnet and the lever in addition to an elastic band 60 that extends around the magnet and the lever 34. The elastic band 60 permits the magnet to be firmly held to the lever 34 until the adhesive bond becomes secure and also provides a resilient cushion for protecting the glass enclosure of the switch 32 if it strikes the same due to incorrect alignment or the like.

The actuating levers 34 are relatively thin as shown in FIG. 2 and have a generally L-shaped configuration as shown in FIG. 3. The levers are pivotable around a pivot shaft 62 that extends generally the full length of the board 24 with the shaft 62 passing through an aperture 64 in each of the levers 34, the aperture being located near the base or shorter portion as shown. A relatively small aperture 66 is also provided near the end of the base portion and is adapted to receive an end portion of a spring 68 which is mounted upon the end of the linkage member 36 of the typewriter key mechanism. The downward movement of the linkage member 36 in response to striking of a typewriter key causes the spring 68 to pivot the lever 34 and bring the magnet 56 into close proximity to the magnetically actuated switch 32. Since the portion of the spring 68 between the linkage member 36 and the aperture 66 is relatively straight, there is positive control of the lever 34 in response to movement of the linkage member 36. Stated in other words, downward movement of the lever 36 will pivot the magnet into close proximity to the switch 32 and subsequent upward movement of the member 36 will cause the lever to pivot away or return the magnet to its normal rest position sufficiently removed so that the magnet has virtually no influence on the contacts within the switch. The spring 68, while positively moving the lever 34 in both directions around the pivot shaft 62, nonetheless permits some softening of the sudden impulse caused by striking of the keys as is desired.

As is best shown in FIG. 2, the levers 34 are preferably aligned with the center of the switches 32 and are suitably spaced apart from one another as shown. To maintain the proper spacing between adjacent levers 34, hollow sleeves 70 are provided which fit around the shaft and loosely contact the side of the levers. It should be understood that the spacing between adjacent switches 32 will largely be determined by the particular structural design of the typewriter itself, i.e., the spacing between the linkage members 36. Since these dimensions are predetermined for any particular typewriter, the apparatus embodying the present invention must be fabricated to provide an actuating lever 34 that is aligned with the corresponding linkage member 36 of the typewriter. Once the relative spacing between adjacent actuating levers 34 is determined, the length of the spacer 70 can easily be determined to maintain the proper spacing. Additionally, the magnetically actuated switches 32 must be positioned so as to be responsive to the movement of the levers 34 and will have alignment substantially identical to the levers as shown in FIG. 2.

While the proportions of the lengths of the base and transverse portions of the L-shaped levers 34 can be determined to permit the magnet to come within close proximity to the switches 32 within the degree of travel of the linkage member 36 so that excessive stress is preferably not applied to either the spring 68 or the linkage member 36, a lateral support member 72 may be provided which extends substantially the length of the board 24 for the purpose of imparting additional strength to the board 24 and to provide a stop surface upon which the transverse elongated portion of the lever 34 may contact. In this regard, the size of the lateral support 72 is preferably such that the magnet comes within close proximity but does not contact the glass enclosure of the switch 32 when the lever contacts the support 72.

In accordance with yet another aspect of the present invention, the close proximity of the switches 32 relative to one another creates a condition whereby the tendency of a magnet of one actuating lever to influence an adjacent switch is greatly increased. If such occurs, the switches will generate erroneous signals that are obviously quite detrimental to the operation of the system. As previously mentioned, the spacing between the switches is largely a function of the structural configuration of the typewriter to which the apparatus is installed and is therefore a practical condition that must be reckoned with. To minimize the possibility of actuating more than one of the reed switches 32 in response to pivoting an actuating lever into close proximity to one of the switches, it has been found desirable to arrange the magnets on the lever so that the adjacent ends of the adjacent magnets have opposite magnetic poles. Stated in other words, the magnets are preferably arranged so that the outermost ends of the magnets 56 alternate their north and south poles so that the flux lines tend to be limited and merely cross from one magnet to the adjacent magnet rather than extend outwardly an appreciable distance. By alternating the poles of the adjacent magnets in this manner, the total magnetic field tends to be neutralized or confined within a limited area when all of the levers are in their normal or rest positions as shown in FIG. 1.

In accordance with yet another aspect of the present invention, the apparatus also includes a magnetic shield material for minimizing the influence of the magnet on more than the desired switch it is intended to actuate. As best shown in FIGS. 2 and 4, a magnetic shield 74 is provided and extends beneath on opposite sides of the switches, as shown by the upward extensions 76 in FIG. 4. The magnetic shield 74 is preferably fabricated from a low residual magnetization or high permeability material, such as numetal or the like. Preferably, mumetal or similar material is used for the reason that it will not rust as will iron or silicon iron material. The composition of mumetal is about 75 percent nickel, about 2 percent chromium, about 5 percent copper and about 18 percent iron, and heat treated in hydrogen at the temperature of about 1100°C. and has a maximum permeability of about 110,000 and very little retentivity. By utilizing the magnetic shield in this manner, the undesirable actuation of more than one switch is substantially minimized, if not precluded, so that the magnet 56 of a lever will only actuate the desired associated switch. It is believed that the extensions 76 have the effect of attracting or capturing the magnetic flux lines to thereby "focus" the flux lines to the particular switch the magnet is intended to actuate, which attraction is believed to minimize extraneous flux lines that could extend to undesirably actuate adjacent switches.

From the foregoing discussion of the magnet considerations, it should also be understood that the actuating levers 34 should not be fabricated from ferromagnetic material, it being preferred that they be made of aluminum, plastic or the like, which will have virtually no magnetic influence on the switches 32.

From the foregoing detailed description, it should be understood that an improved apparatus for use in adapting a typewriter for generating electrical signals that are indicative of the characters being typed has been shown and described. The apparatus is easily installed and is reliable in its operation. Moreover, the relative compactness of the overall design permits a conventional typewriter to perform the additional function of generating a magnetic tape recording of the information as it is being typed, if desired. The recording can then be transmitted using conventional equipment either locally for processing or over telephone circuits at high speed. The operation of the apparatus is extremely quiet and does not increase typewriter noise and does not otherwise interfere with the normal operation of the typewriter. The easy access to the reed switches and other components of the apparatus facilitates convenient maintenance and permits easy replacement of switches and other components in the event a malfunction occurs.

It should be understood that although preferred embodiments of the present invention have been illustrated and described, various modifications thereof will become apparent to those skilled in the art and, accordingly, the scope of the present invention should be defined only by the appended claims and equivalents thereof.

Various features of the invention are set forth in the following claims.

What is claimed is:

1. Apparatus for attachment to a typewriter for selectively actuating a plurality of electrical switch means in response to depressing the keys of a typewriter, comprising, in combination:

support means for attachment to the underside of a typewriter generally beneath the keyboard thereof, said support means being adapted to support a plurality of switch means adjacent one another;

a plurality of magnetically actuated switch means positioned adjacent one another and extending along said support means generally across the width of the keyboard;

a plurality of pivotable actuating levers positioned adjacent said switch means, each of said levers being operably associated with a key of said typewriter and with one of said switch means so that pivotal movement of one of said actuating levers occurs in response to depression of its associated typewriter key and a portion of said lever is pivoted into close proximity to the associated switch means;

a magnet secured to said portion of said actuating lever that is moved into close proximity to said switch means, said magnet actuating said switch means when in close proximity thereto;

an elastic band applied around one or more of said magnets and said levers to hold said magnets on said levers and to provide a resilient protective cushion;

the polarity of adjacent magnets being reversed so that adjacent ends of adjacent magnets have opposite magnetic poles; and, magnetic shield means positioned intermediate adjacent switch means and adapted to prevent actuation of more than one switch means in response to depression of any one of said typewriter keys.

2. Apparatus as defined in claim 1 wherein each of said switch means is operably associated with an electric circuit so that depression of a typewriter key produces electrical signals indicative of the key being depressed.

3. Apparatus as defined in claim 1 wherein one or more of said magnets are adhesively bonded to said actuating lever.

4. Apparatus as defined in claim 1 wherein said magnets have north and south poles at opposite ends thereof, and have a magnetic strength within the range of about 15 to about 45 gauss.

5. Apparatus as defined in claim 1 wherein said magnetic shield comprises a relatively thin generally continuous narrow strip of high permeability magnetic material positioned on opposite sides of said switch means, the height of said shield between adjacent switch means being generally coextensive with the switching contacts therewithin.

6. Apparatus as defined in claim 1 wherein each of said switch means comprises a magnetically actuated encapsulated reed switch.

7. Apparatus as defined in claim 1 wherein spring means couple each of said actuating levers to linkage members of the associated key of the typewriter key mechanism.

8. Apparatus as defined in claim 1 including an elongated pivot shaft extending generally the width of the keyboard adjacent said support means, each of said actuating levers having an aperture through which said shaft passes to define the pivot therefor, and spacer sleeves located intermediate adjacent actuating levers for maintaining adjacent actuating levers a predetermined distance from one another and for maintaining said levers in alignment with the switch means with which it is associated.

9. Apparatus as defined in claim 1 wherein said support means comprises a generally thin flat member extending generally the width of said typewriter keyboard and fabricated from an electrically insulating material and having electrical conductors deposited thereon which extend to respective switch means.

10. Apparatus for attachment to a typewriter for selectively actuating a plurality of electrical switch means in response to depressing the keys of a typewriter, comprising, in combination:

support means for attachment to the underside of a typewriter generally beneath the keyboard thereof, said support means being adapted to support a plurality of switch means adjacent one another;

a plurality of magnetically actuated switch means positioned adjacent one another and extending along said support means generally across the width of the keyboard;

a plurality of pivotable actuating levers positioned adjacent said switch means, each of said levers being operably associated with a key of said typewriter and with one of said switch means so that pivotal movement of one of said actuating levers occurs in response to depression of its associated typewriter key and a portion of said lever is pivoted into close proximity to the associated switch means;

spring means coupling each of said actuating levers to linkage members of the associated key of the typewriter key mechanism;

a magnet secured to said portion of said actuating lever that is moved into close proximity to said switch means, said magnet actuating said switch means when in close proximity thereto; and, magnetic shield means positioned intermediate adjacent switch means and adapted to prevent actuation of more that one switch means in response to depression of any one of said typewriter keys.

11. Apparatus as defined in claim 10 including an elastic band applied around one or more of said magnets and said levers to hold said magnets on said levers and to provide a resilient protective cushion.

12. The improvement as defined in claim 2 wherein said shield means is fabricated of Mumetal having a composition of about 75 percent nickel, about 2 percent chromium, about 5 percent copper and about 18 percent iron and heat treated in hydrogen at a temperature of about 1100°C.

13. The improvement as defined in claim 10 wherein adjacent magnets of adjacent switches in the array are alternatively reversed so that adjacent poles of adjacent magnets are of opposite magnetic polarity.

14. Apparatus for attachment to a typewriter for selectively actuating a plurality of electrical switch means in response to depressing the keys of a typewriter, comprising, in combination:

support means for attachment to the underside of a typewriter generally beneath the keyboard thereof, said support means being adapted to support a plurality of switch means adjacent one another;

a plurality of magnetically actuated switch means positioned adjacent one another and extending along said support means generally across the width of the keyboard;

a plurality of pivotable actuating levers positioned adjacent said switch means, each of said levers being operably associated with a key of said typewriter and with one of said switch means so that pivotal movement of one of said actuating levers occurs in response to depression of its associated typewriter key and a portion of said lever is pivoted in close proximity to the associated switch means;

an elongated pivot shaft extending generally the width of the keyboard adjacent said support means, each of said actuating levers having an aperture through which said shaft passes to define the pivot therefor, and spacer sleeves located intermediate adjacent actuating levers for maintaining adjacent actuating levers a predetermined distance from one another and for maintaining said levers in alignment with the switch means with which it is associated;

a magnet secured to said portion of said actuating lever that is moved into close proximity to said switch means, said magnet actuating said switch means when in close proximity thereto; and, magnetic shield means positioned intermediate adjacent switch means and adapted to prevent actuation of more than one switch means in response to depression of any one of said typewriter keys.

* * * * *